US005392739A

United States Patent [19]

Jones

[11] Patent Number: 5,392,739

[45] Date of Patent: Feb. 28, 1995

[54] STEAM-RAISING SYSTEM

[75] Inventor: Howard C. Jones, Heath, England

[73] Assignee: Eaton-Williams Group Limited, Edenbridge, England

[21] Appl. No.: 82,052

[22] Filed: Jun. 25, 1993

[30] Foreign Application Priority Data

Jun. 26, 1992 [GB] United Kingdom ..... 9213594

[51] Int. Cl.[6] ..... F22D 5/26

[52] U.S. Cl. ..... 122/451 R; 122/406.4; 122/406.5; 122/451.1; 122/451.2; F22D/5/26

[58] Field of Search ..... 122/451, 406.4, 406.5, 122/451.1, 451.31

[56] References Cited

U.S. PATENT DOCUMENTS

| | | | |
|---|---|---|---|
| 1,824,969 | 9/1931 | Veenschuten | 122/451 R |
| 4,242,989 | 1/1981 | Chamberlain | 122/451 R |
| 4,404,930 | 9/1983 | Chen | 122/451 R |
| 4,541,365 | 9/1985 | Jennings et al. | 122/451 R |

*Primary Examiner*—Edward G. Favors
*Attorney, Agent, or Firm*—Dickinson, Wright, Moon, Van Dusen & Freeman

[57] ABSTRACT

A steam-raising system comprising a boiler, a pump connected by a flow passageway to the boiler to pump water thereto, and flow-control means connected to the flow passageway between the pump and the boiler to control the flow of water from the pump to the boiler. The flow-control means comprise at least two relief means in parallel with one another, but with their points of connection to the flow passageway between the pump and the boiler spaced apart in series with one another. The invention extends to method of operating a steam-raising system such that the system is controlled to keep its condition close to a minimum of the temperature and/or pressure of output from a boiler of the system expressed as a function of the flowrate of water supplied to the boiler.

7 Claims, 1 Drawing Sheet

STEAM-RAISING SYSTEM

The present invention relates to a steam-raising system, especially but not exclusively a system comprising a flash boiler.

Previous such systems are described in WO-A-88 04390 and WO-A-89 12782 of Cubit Limited. Both of these systems are intended to produce steam, but their constructions render it difficult to control the throughput of water through the system carefully. This results in a problem that the condition of the steam produced is difficult to control accurately.

It is an aim of the present invention to provide a steam-raising system which is operable in a more controlled manner.

One aspect of the present invention is accordingly directed to a steam-raising system comprising a boiler, a pump connected by a flow passageway to the boiler to pump water thereto, and flow control means connected to the flow passageway between the pump and the boiler to control the flow of water from the pump to the boiler, in which the flow-control means comprise at least two relief means in parallel with one another, but with their points of connection to the flow passageway between the pump and the boiler spaced apart in series with one another.

This affords an advantage of allowing the flow-control means to control the throughput of water more carefully.

Preferably the relief means each comprise a preset valve and a solenoid-operated valve connected in series with one another.

This has the advantage that the system can be calibrated initially by setting the preset valves to a desired opening and thereafter using the solenoid-operated valves as on/off switches to control the throughput of water from the pump to the boiler.

Advantageously, the solenoid-operated valves are switched by a common control device in dependence upon the temperature and/or pressure of steam produced by the boiler.

One problem which previously proposed steam-raising systems have sought to cope with is the efficient production of substantially dry steam.

A second aspect of the present invention seeks to provide a ramedy.

It has been found that the temperature and/or pressure of the output from a flash boiler expressed as a function of the flowrate of water into the boiler, for relatively low flowrates, falls as the flowrate increases. This occurs whilst the steam output is dry and superheated. An increase in the water input to the boiler results in larger quantities of water having to be converted into steam by the same supply of heat to the water by the boiler, resulting in a lower temperature and/or pressure of the output from the boiler. However, at a transitional phase with a further increase in the supply of water to the boiler, the amount of heat generated in the boiler is only just sufficient to boil all the water, and the back-pressure built up in the boiler as a result of an excessive supply of water thereto begins to take effect. This results in first a minimum occurring in the temperature and/or pressure plotted against water supplied, and then a steady climb, so that apart from the minimum point, a given temperature and/or pressure can be achieved with two different input flowrates.

The second aspect of the present invention is directed to a method of operating a steam-raising system such that the system is controlled to keep its condition close to a minimum of the temperature and/or pressure of output from a boiler of the system expressed as a function of the flowrate of water supplied to the boiler.

A steam-raising system made in accordance with the present invention, and a method of operating a steam-raising system, will now be described with reference to the accompanying drawings in which.

Figure 1:
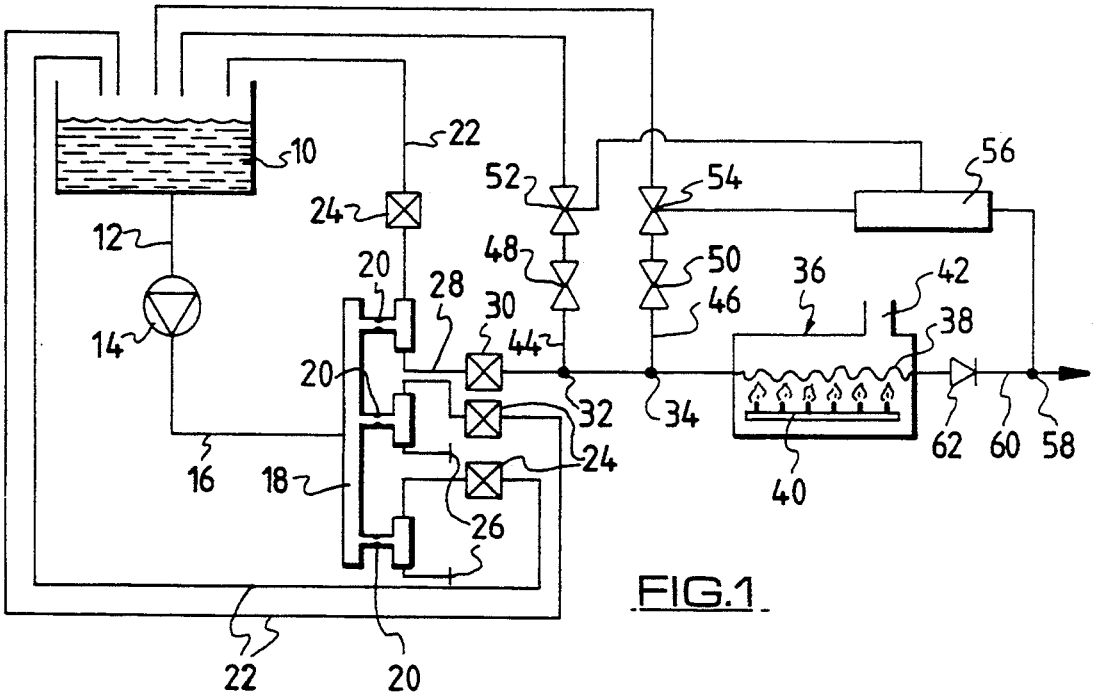
FIG. 1 shows an hydraulic circuit of such a system in diagrammatic form.

FIG. 1 shows a steam-raising system diagrammatically. A reservoir or tank 10 is connected by a feed line 12 to a 3-cylinder positive-displacement pump 14. The pump 14 is in turn connected by a line 16 to a common qallery or chamber 18. The common gallery 18 has three outlets 20 (although it is possible to have more outlets). The outlets 20 are each equipped with nozzles or orifices to provide a minimum back-pressure for the pump 14. Each outlet 20 has two lines extending from it. Thus, each of the three outlets 20 has one of its two lines constituted by a return line 22 which runs back to the reservoir 10 and which is equipped with an open-or-close solenoid-operated valve 24. Two of the outlets 20 each have the other of their two lines 26 blanked off. The third outlet has its second line 28 connected to a flash boiler 36. The line 28 includes an open-or-close solenoid-operated valve 30 and, downstream of the valve 30, two T-junctions 32 and 34, in series with one another, before it reaches the flash boiler 36. The flash boiler 36 comprises a heat-exchanger coil 38 and a gas burner 40 arranged to apply heat to the coil 38. Combustion products from the burner 40 pass out from the flash boiler 36 via a flue 42. The coil 38 is connected at its other end to an output line 60.

The T-junctions 32 and 34 are connected to respective lines 44 and 46 which return to the reservoir 10. The lines 44 and 46 incorporate respective preset regulator valves 48 and 50 (these valves may be, for example, regulator valves or metering valves). The latter has a smaller orifice than the former, although they could be of the same size as one another. Respective solenoid-operated shut-off valves 52 and 54 are provided downstream of the preset valves 48 and 50. The solenoid valves 52 and 54 are both connected to and are both operated by a controller 56 which is also connected to receive output signals from a temperature and/or pressure sensor 58 in the line 60 downstream of the flash boiler 36.

The line 60 is also equipped with an open or close valve 62. The output line 60 finally leads to an output port to which is connected the steam-consuming appliance (not shown) when the system is in use.

The system operates in the following manner.

Water is fed from the reservoir 10 to the pump 14 via the line 12. The level of water in the reservoir is kept constant by a float control device attached to an inlet line (not shown). The pump 14 then forces the water along the line 16 under high pressure into the common gallery 18.

The high-pressure water passes through the nozzles 20. The water pressure in the common gallery 18 may be controlled by means of the solenoid-operated valves 24 attached to the return lines 22. When the system is ready for producing steam, the valve 30 is opened so that water from the pump 14 passes along line 28 to the boiler 38.

The amount of the water supplied to the flash boiler 38 is adjusted to a desired level to a first approximation by a command signal from the controller 56 opening the valve 52 in the return line 44. The amount of water which passes on to the boiler 38 is determined by the relative size of the effective orifice of the preset valve 40.

A more precise adjustment is achieved by control of the solenoid-operated valve 54 in the other return line 46.

Water which continues to pace along the line 28 then passes through the coil 38 and is heated by the burner 40. The take-off of the steam produced is controlled by the valve 62 and the temperature and/or pressure of the steam taken off is monitored by the temperature sensor 58.

Figure 2:
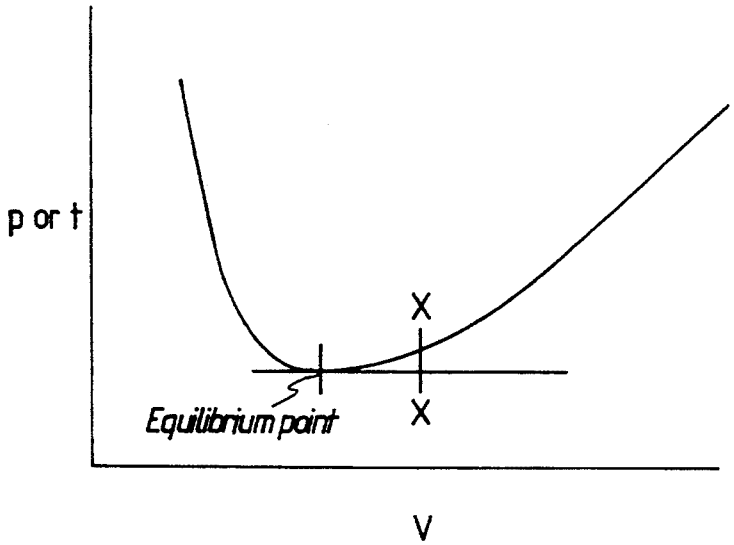
FIG. 2 shows a graph of temperature and/or pressure of the output from a boiler of the system plotted against the flowrate of water supplied to the boiler.

FIG. 2 shows a graph of temperature and/or pressure of the output from the system plotted against the flowrate of water supplied to the boiler. On the left-hand side of the graph the curve rises towards the temperature and/or pressure axis as the flowrate of water supplied decreases. This is because, for a given amount of heat supplied by the burner, a higher temperature of steam is produced. The steam produced here is superheated. Conversely, with increasing flowrate, the pressure and/or temperature falls. Eventually an equilibrium point is reached at which "dry" but not superheated steam is produced. This occurs at a minimum of the temperature/flowrate graph. Beyond the minimum, with increasing flowrate, the temperature and/or pressure climbs as a result of increasing back-pressure with increasing supply of water to the boiler. Thus, on the right-hand side of the graph the temperature and/or pressure of the output of the system rises with increased flowrate. On this side of the graph, a mixture of steam and water, or "wet" steam, is produced.

Control of the system will no be described in greater detail with reference to FIG. 2.

The preset valve 48 is set to operate the system close to the condition indicated at line X—X on the graph. If the temperature/pressure sensed by the sensor 58 increases beyond the value at X—X, the controller 56 switches the valve 54 open, so that more water is returned to the reservoir 10 and less passes to the boiler 36. The condition of the system therefore moves to the left in FIG. 2, towards the equilibrium point. In the event that the temperature/pressure falls below the value it has at X—X in FIG. 2, the controller 56 closes the valve, and the condition of the system moves to the right in the graph of FIG. 2.

It is believed that the electronic circuitry required for the controller 56 will be readily apparent to a person of ordinary skill in the art of electronics, so it will not be described in detail here.

Numerous modifications and variations to the illustrated flash boiler system may be made without taking the resulting construction outside the scope of the present invention. For example, if the controller 56 is provided with a large memory and data giving a complete plot of the curve shown in FIG. 2, it would be possible to have the line X—X right on the minimum. Opening or closing of the valve 54 would in that case be determined by an upward increase of the temperature and/or pressure beyond a given value, and/or by the characteristics of the increase.

A further boiler, together with accompanying controls corresponding to the preset valves 48 and 50 and the open-or-close valves 52 and 54 connected to the controller 56, may be connected to one or each of the blanked-off lines 26, with both or all of the boilers having respective shut off valves 62 but sharing a common output port (not shown). Such a further boiler or boilers, with controls, may be of modular construction, and may be added to an existing installation.

I claim:

1. A steam raising system comprising a boiler, a pump connected by a flow passageway to the boiler to pump water thereto, and flow-control means connected to the flow passageway between the pump and the boiler to control the flow of water from the pump to the boiler, wherein the flow-control means comprise at least two flow-redirecting-relief means in parallel with one another, but with their points of connection to the flow passageway between the pump and the boiler spaced apart in series with one another.

2. A steam-raising system according to claim 1, wherein the relief means each comprise a preset valve and a solenoid-operated valve connected in series with one another.

3. A steam-raising system according to claim 2, wherein the solenoid-operated valves are switched by a common control device in dependence upon a parameter of steam produced by the boiler.

4. A method of operating a steam-raising system comprising measuring an output parameter from a boiler of the system that varies with flow rate and controlling the system to maintain the value of said parameter close to a minimum when said parameter is expressed as a function of the flowrate of water supplied to the boiler.

5. A method of operating a steam-raising system according to claim 4, wherein the steam raising system comprises a boiler, a pump connected by a flow passageway to the boiler to pump water thereto, and flow-control means connected to the flow passageway between the pump and the boiler to control the flow of water from the pump to the boiler, wherein the flow-control means comprise at least two flow-redirecting-relief means in parallel with one another, but with their points of connection to the flow passageway between the pump and the boiler spaced apart in series with one another.

6. A. steam-raising system comprising a boiler, a pump connected by a flow passageway to the boiler to pump water thereto, and flow-control means connected to the flow passageway between the pump and the boiler to control the flow of water from the pump to the boiler, wherein the flow-control means comprise at least two relief means in parallel with one another, but with their points of connection to the flow passageway between the pump and the boiler spaced apart in series with one another, and wherein the relief means each comprise a preset valve and a solenoid-operated valve connected in series with one another.

7. A steam-raising system according to claim 6, wherein the solenoid-operated valves are switched by a common control device in dependence upon a parameter of steam produced by the boiler.

* * * * *